US005634285A

United States Patent [19]

Renski

[11] Patent Number: 5,634,285

[45] Date of Patent: Jun. 3, 1997

[54] BASE EDGE COVER FOR A BUCKET AND APPARATUS FOR RETAINING SAME

[75] Inventor: William J. Renski, Peoria, Ill.

[73] Assignee: Caterpillar Inc., Peoria, Ill.

[21] Appl. No.: 536,415

[22] Filed: Sep. 29, 1995

[51] Int. Cl.[6] ..... E02F 9/28

[52] U.S. Cl. ..... 37/456; 37/459; 37/450; 403/355

[58] Field of Search ..... 37/444, 445, 446, 37/449, 450, 451, 452, 453, 454, 455, 456, 457, 458, 459; 403/355, 356, 376, 378, 380, 319

[56] References Cited

U.S. PATENT DOCUMENTS

| | | | |
|---|---|---|---|
| 1,220,186 | 3/1917 | Chambers | 37/455 X |
| 1,620,132 | 3/1927 | Psilander | 37/454 |
| 2,311,463 | 2/1943 | Page | 37/455 |
| 2,393,706 | 1/1946 | Page | 37/455 |
| 2,472,892 | 6/1949 | George | 37/454 |
| 3,057,091 | 10/1962 | Petersen | 37/454 |
| 3,426,459 | 2/1969 | Petersen | 37/446 X |
| 3,462,861 | 8/1969 | Kampert | 37/455 X |
| 3,919,792 | 11/1975 | Hahn et al. | 37/455 |
| 4,414,764 | 11/1983 | Johansson et al. | 37/450 |
| 4,428,131 | 1/1984 | Hahn | 37/453 |
| 4,587,751 | 5/1986 | Sjogren et al. | 37/453 |
| 4,748,754 | 6/1988 | Schwappach | 37/453 X |
| 4,848,013 | 7/1989 | Bowman et al. | 37/142 A |
| 4,918,843 | 4/1990 | Kiesewetter et al. | 37/142 A |
| 5,068,986 | 12/1991 | Jones | 37/446 X |
| 5,088,214 | 2/1992 | Jones | 37/451 X |
| 5,172,500 | 12/1992 | Renski et al. | 37/142 A |
| 5,241,765 | 9/1993 | Jones et al. | 37/451 X |
| 5,272,824 | 12/1993 | Cornelius | 37/455 X |
| 5,423,138 | 6/1995 | Livesay et al. | 37/455 X |

*Primary Examiner*—Terry Lee Melius
*Assistant Examiner*—Victor Batson
*Attorney, Agent, or Firm*—O. Gordon Pence

[57] ABSTRACT

Apparatus is provided for protecting a base edge of a ground engaging implement of a work machine from wear. The apparatus includes a base edge cover and retaining apparatus of a construction adapted for time saving removal and installation. A mounting base is carried on the upper face of the base edge and has an opening therein. An upper flange element of the base edge cover has a bar projecting inwardly therefrom toward the upper face of the base edge. The bar is positionable within the opening of the mounting base and is captured in such opening by a detachable lock. The construction results in a reduction of waste of materials that must be discarded after the base edge cover is worn out.

6 Claims, 5 Drawing Sheets

BASE EDGE COVER FOR A BUCKET AND APPARATUS FOR RETAINING SAME

TECHNICAL FIELD

The present invention relates to a cover for protecting the base edge of a ground engaging implement of a work machine.

BACKGROUND ART

Edge covers for protecting a base edge of a bucket or other ground engaging tool are well known in the art. These base edge covers and apparatus for retaining such covers to the base edge are of various construction. Most, if not all, of the heretofore designs have shortcomings that cause the end product to be less than desirable.

The primary factors desired in constructing an edge cover that has characteristics of long wear and avoids the waste of material, labor and natural resources include sufficient strength to withstand the harsh environment and impacts, long life span, little waste of materials after the cover is worn out, and quick and easy installation.

The present invention is directed to overcome one or more of the problems as set forth above.

DISCLOSURE OF THE INVENTION

In one aspect of the invention, apparatus are provided for protecting a base edge of a ground engaging implement of a work machine. The base edge has an upper face and a lower face and the apparatus includes a base edge cover having a forward ground engaging portion and a reward mounting portion. The rearward mounting portion has an upper flange element extending along the upper face of the base edge and a lower flange element extending along the lower face of the base edge and defines a throat therebetween for receiving the base edge.

A mounting base is carried on the upper face of the base edge and has an opening therein. The upper flange element of the base edge cover has a bar projecting inwardly therefrom toward the upper face of the base edge. The bar is positionable within the opening of the mounting base.

A lock is provided for selectively retaining the bar within said opening.

BEST MODE FOR CARRYING OUT THE INVENTION

Figure 1:
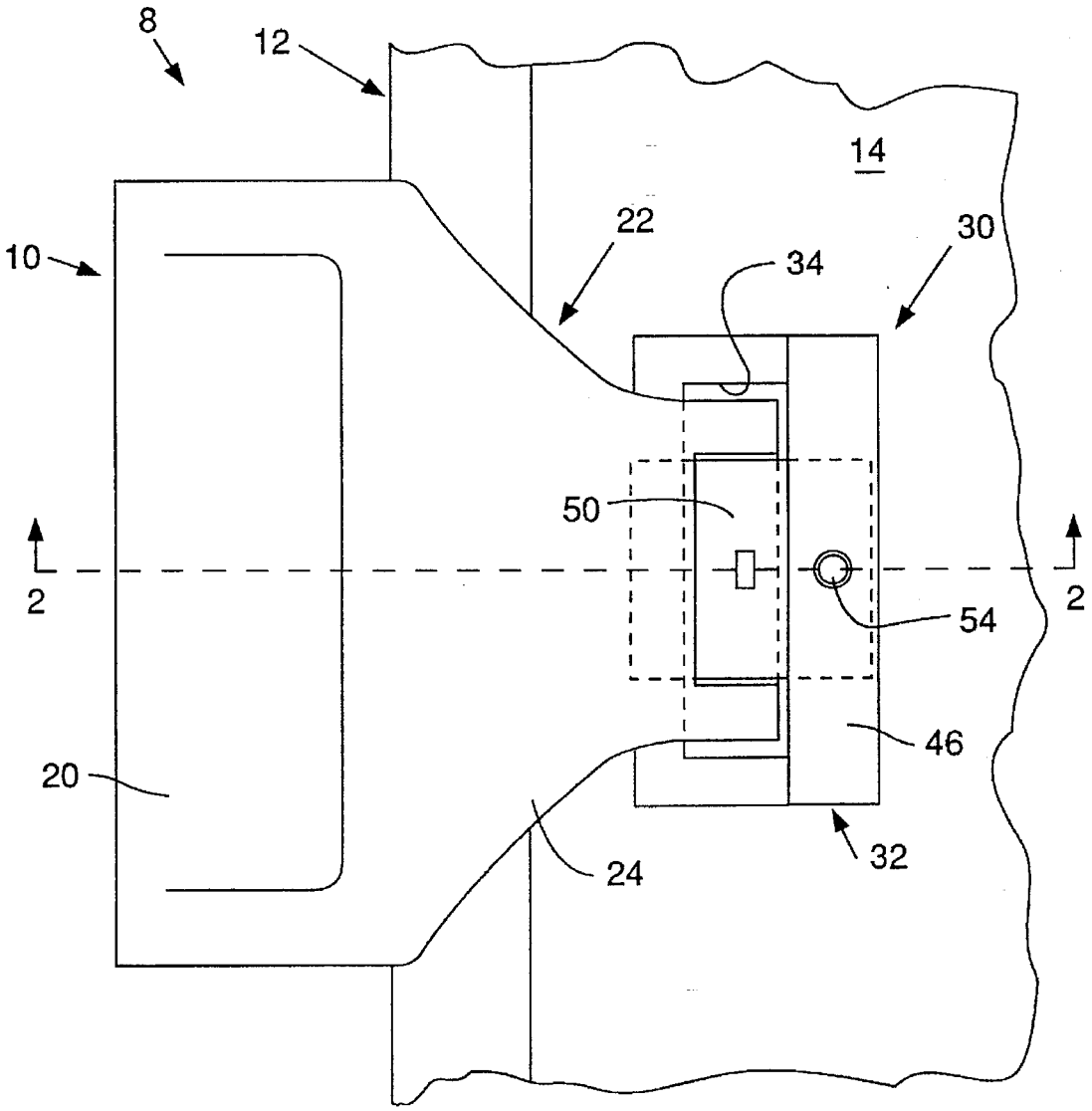
FIG. 1 is a diagrammatic top view of one embodiment of the invention.
Figure 2:
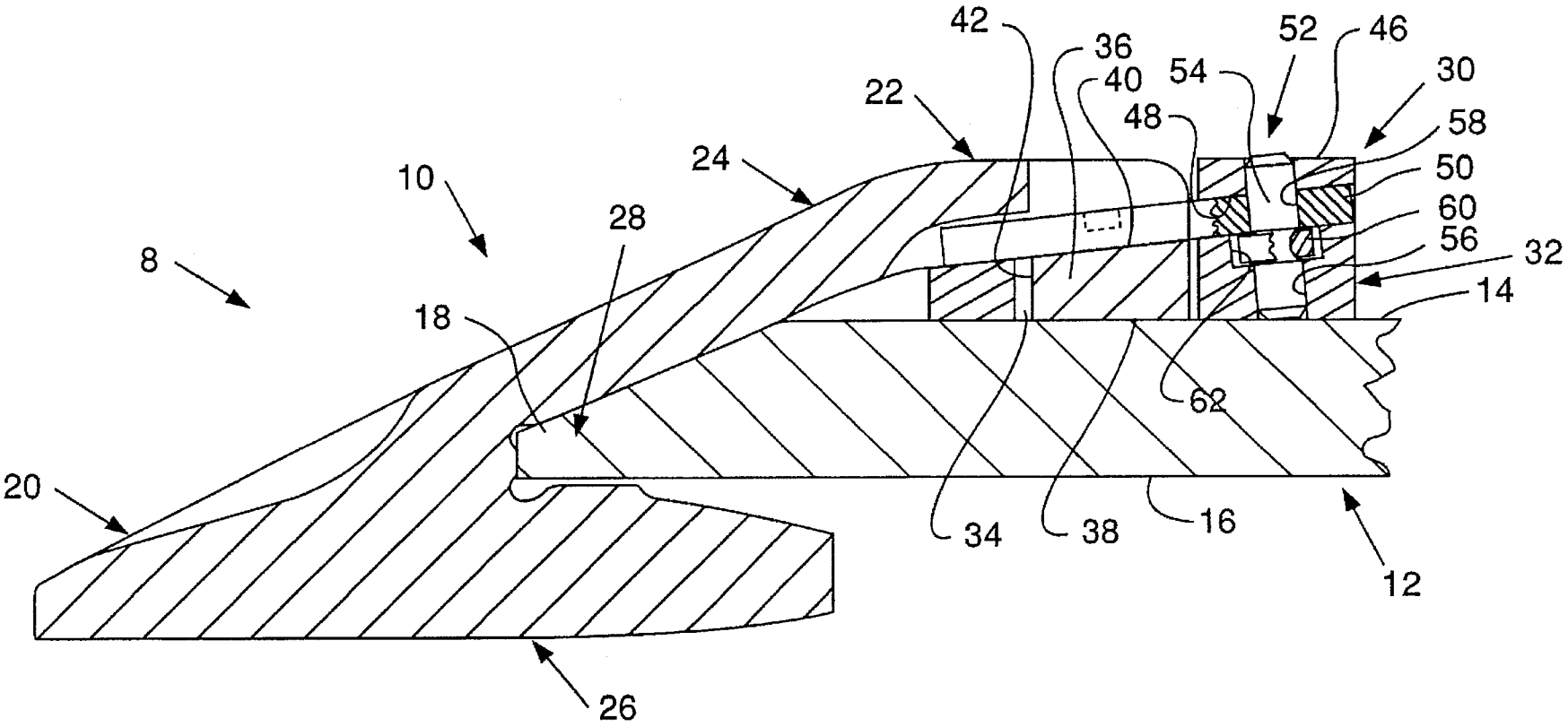
FIG. 2 is a diagrammatic cross-sectional view taken along line 2—2 of FIG. 1.
Figure 3:
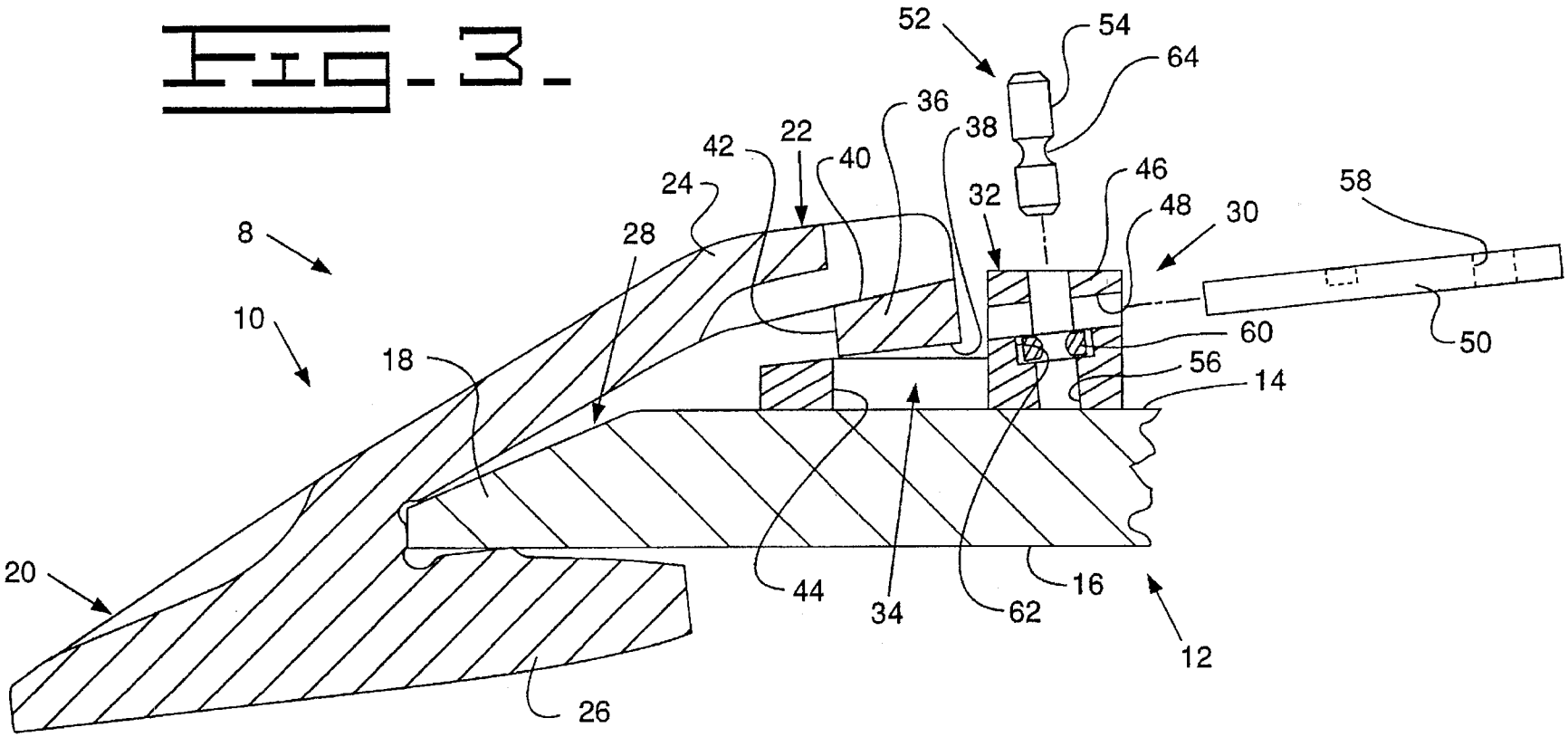
FIG. 3 is a diagrammatic cross-sectional view similar to FIG. 2, but with the components exploded.

Referring to FIGS. 1–3, apparatus 8 embodying the principles of the present invention is provided for protecting a base (cutting) edge 12 of a ground engaging implement, such as a bucket of a wheel loader, for example (not shown). Apparatus 8 includes a base edge cover 10. The typical base edge 12 is constructed from steel plate and has an upper face 14, a lower face 16 and a tapered leading edge 18. The base edge 12, as set forth above, is a portion of an implement of a work vehicle which is not shown for purposes of brevity since such base edges implements are well known in the art.

The base edge cover 10 is generally wedge shaped, with a forward ground engaging portion 20 and a reward mounting portion 22. The mounting portion 22 has first and second spaced apart flange elements, an upper flange element 24 and a lower flange element 26, defining an base edge receiving throat 28 therebetween.

The base edge cover 10 is constructed in conjunction with and apparatus 30 is provided for detachably retaining the base edge cover on the base edge 12. Apparatus 30 includes a mounting base 32 that is secured, preferably by welding, to upper face 14 of the base edge, but, without departing from this invention, can be a unitary portion of the base edge 12 or connected thereto by bolts or other means. The mounting base 32 is provided with an opening 34 that is adapted to receive a laterally extending bar 36 provided on the upper flange element 24 of the base edge cover 10. The bar 36 projects downwardly from the upper flange element 24 and has a bottom surface 38 located to contact the upper face 14 of the base edge 12, an upper surface 40, and a forward side 42. The forward side 42 is disposed in abutting relation to a rearward facing side of opening 34 when in the installed position as shown in FIG. 2 to prevent the cover 10 from coming off the base edge 12 during use. The mounting base 32 also includes an upright flange 46 at its rearward end. A longitudinally extending opening 48 is provided through the upright flange 46. Such opening is adapted to receive an elongated lock 50. The lock 50 is adapted to extend through the opening 48 to a locking position over the top of the bar 36 for selectively retaining the bar 36 within the opening 34.

Suitable retaining apparatus 52 are provided for releasably maintaining the lock 50 in its locking position within the opening 48. Such retaining apparatus includes a pin 54, which is positionable in a hole 56 provided in the upright flange 46 and a similar hole 58 through the lock 50. Holes 58 and are alignable when the lock is disposed in its installed position as shown in FIG. 1. The pin 54, in turn, is held in place by a snap ring-type retainer 60, which resides in a counterbore 62 in hole 56 and engages a rounded detent groove 64 (FIG. 3) provided in the pin 54. The pin 54 is driven through the retainer 60 until the retainer engages the groove The pin 54 can be removed by driving it in the opposite direction to release the retainer 60 from the detent groove 64. As those skilled in the art will appreciate, this may be accomplished in any suitable manner, such as by prying against the bottom end of the pin 54 with a suitable pry bar (not shown), which may be inserted through an access slot (not shown) extending through the upright flange 46 into the hole 56.

Figure 4:
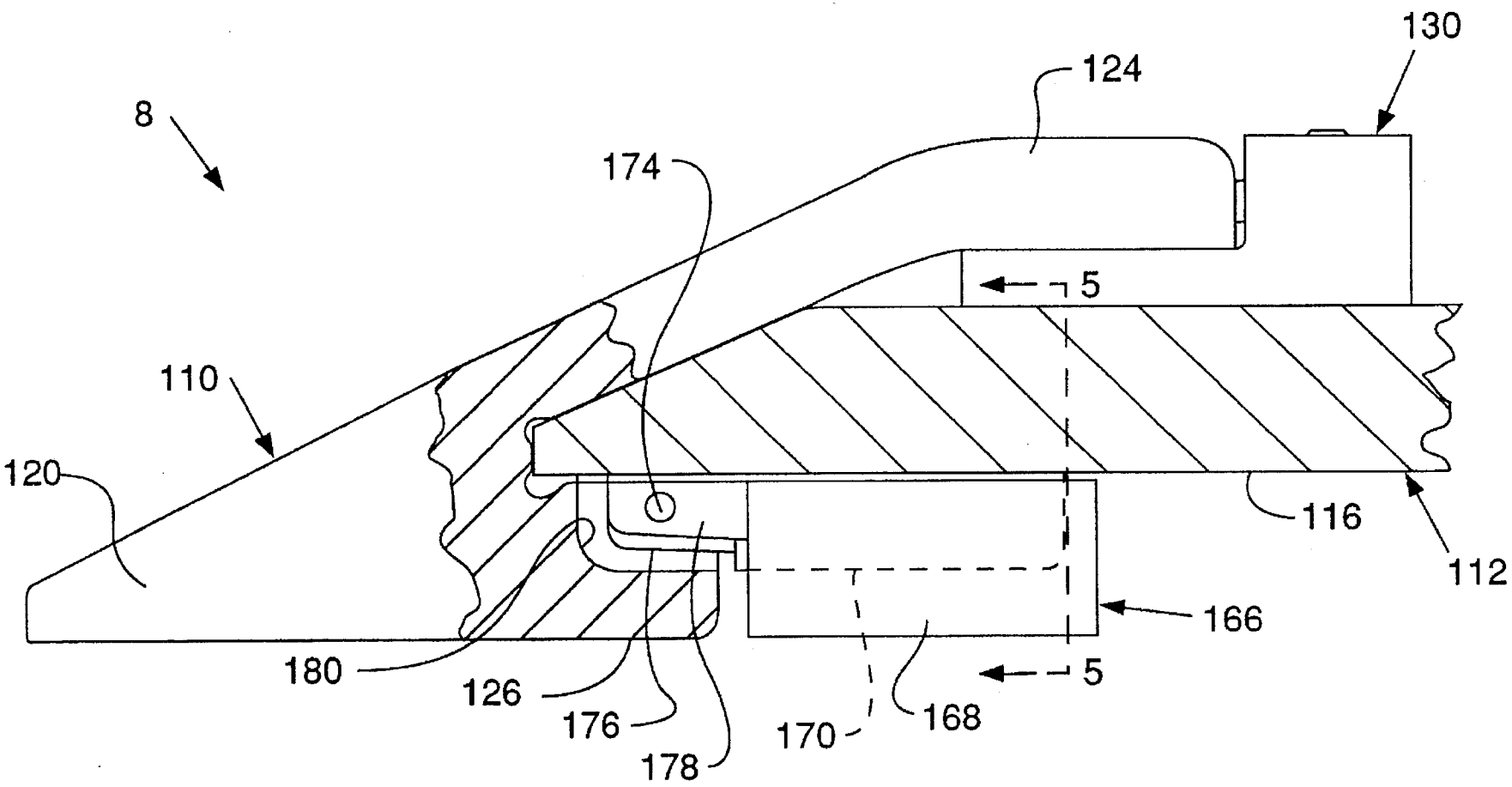
FIG. 4 is a diagrammatic cross-sectional view similar to FIG. 2, but of another embodiment of the invention.
Figure 5:
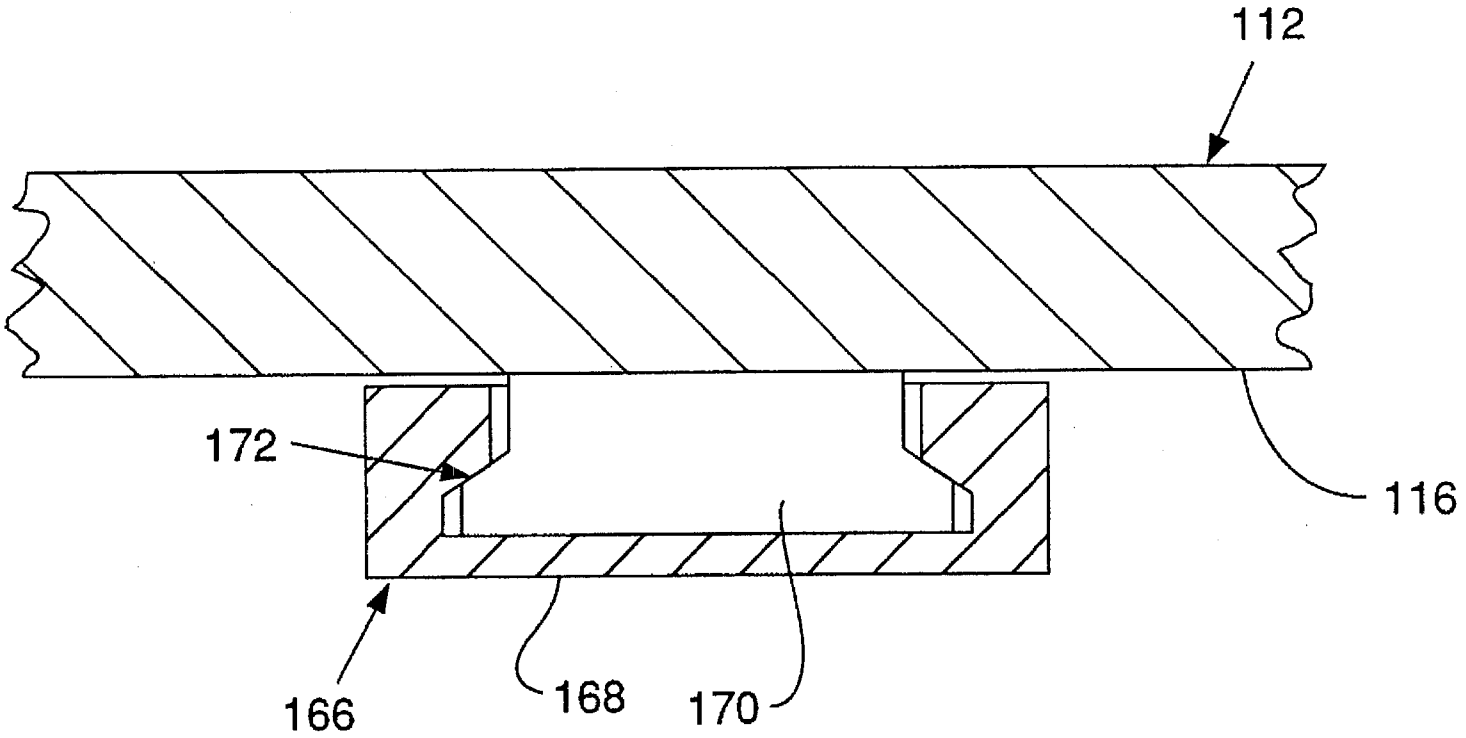
FIG. 5 is a diagrammatic cross-sectional view taken along line 5—5 of FIG. 4.

Referring now to FIGS. 4 and 5, an alternate embodiment of the present invention is disclosed, wherein similar components are referenced by similar reference numerals preceded by a "1". The second embodiment includes a base edge cover 110 that has a forward portion 120 and an upper flange element 124 which may be identical to the corresponding forward portion 20 and upper flange element 24 of the preceding embodiment. Mounting apparatus 130 is also the same as mounting apparatus 30. The lower flange portion 126, however, is made shorter than the corresponding lower flange portion 26 of the preceding embodiment and the embodiment of FIGS. 4 and 5 includes a replaceable wear runner 166. Wear runner 166 includes a wear cover 168 and a mounting base 170. The mounting base 170 is secured to the bottom surface 116 of base edge 112, preferably by welding. The wear cover 168 is constructed so as to be slidably mounted on the mounting base 170 by means of a mating internal dove tail construction 172 shown in FIG. 5. The wear cover 168 is detachable retained on the mounting base 172 by means of a pin 174. The pin 174 is preferably mounted through alienable pin holes provided in the mounting base 172 and cover 168. Such pin holes are provided in a forwardly extending ear 176 of mounting base 170 and in a mating pair of ears 178 (only one shown) provided on cover 168. Such pin 174 may be installed through the ears 176, 178 before the base edge cover 110 is installed and are protected by location within a pocket 180 provided in the lower flange element 126 of the cover 110.

Industrial Applicability

The apparatus 8 of this invention is easily removed and installed and represents a saving of labor and machine down time. The base edge cover 10, base edge 12 and mounting apparatus 30 are dimensioned and are of a construction sufficient for the insertion of the bar 36 of the upper flange element 24 into the opening 34 of the mounting base 32 as shown in FIG. 3. When the base edge cover 10 is in the installed position as shown in FIG. 2, the lock 50 may be installed though opening 48. The lock is retained by the insertion of the pin 54 which, in turn, is retained by the snap ring 60. After the lock 50 is installed, the bar 36 becomes captured within the opening 34 to retain the cover 10 on the base edge 12 and to prevent its loss during operation.

The primary forces exerted on the base edge cover 10 during operation of the machine are transferred directly onto the base edge 12 through engagement of the mating surfaces in the throat 28 of the cover with the leading edge 18 of the base edge 12. Upward forces exerted on the base edge cover 10 are carried from the lower flange element 26 into the lower face 16 of the base edge, with moment loads being transferred into the upper surface 14 through the contacting bottom surface 38 of the bar 36 of the upper flange element 26 of the cover 10.

The preceding description and operation for the embodiment shown in FIGS. 1–3 apply as well to the embodiment depicted in FIGS. 4 and 5. However, the second embodiment incorporates the use of a separately replaceable wear runner 166. The use of the separate wear runner 166 is advantageous because it allows the separate replacement of either the edge cover 110 or the wear cover 168, depending on which of such components needs to be replaced due to wear. This use reduces the waste of material in that less iron need be thrown away when only one component needs replacing.

Other aspects, objects and advantages of this invention can be obtained from a study of the drawings, the disclosure and the claims.

I claim:

1. Apparatus for protecting a base edge of a ground engaging implement of a work machine, said base edge having an upper face and a lower face, comprising:

a base edge cover having a forward ground engaging portion and a rearward mounting portion, said rearward mounting portion having an upper flange element extending along said upper face of the base edge and a lower flange element extending along the lower face of said base edge and defining a throat therebetween for receiving said base edge;

a mounting base carried on the upper face of said base edge, said mounting base having an opening therein;

said upper flange element of said base edge cover having a bar projecting inwardly therefrom toward said upper face of the base edge, said bar being positionable within said opening of said mounting base;

a lock for selectively retaining said bar within said opening; and said mounting base including an upright flange having a longitudinally extending opening, said opening being adapted to receive and position said lock in a locking position over the top of said bar.

2. The apparatus, as set forth in claim 1, including retaining apparatus for releasably maintaining the lock in its locking position.

3. The apparatus, as set forth in claim 2, wherein said retaining apparatus includes:

a hole in said upright flange and an alignable hole in said lock; and a pin insertable through said holes in said upright flange and said lock.

4. The apparatus, as set forth in claim 1, including a replaceable wear runner, said wear runner including a mounting base carried on the lower face of said base edge and a wear cover, said wear cover being slidably mounted on said mounting base.

5. The apparatus, as set forth in claim 4, wherein said mounting base has a forwardly extending ear and said cover has a pair of mating ears, said ears being provided with alienable pin holes for receiving a pin for detachably retaining said cover to said mounting base.

6. The apparatus, as set forth in claim 5, wherein said lower flange element of said base edge cover is provided with a pocket, and wherein said ears and pin are located within said pocket when the edge cover is installed.

* * * * *

UNITED STATES PATENT AND TRADEMARK OFFICE

CERTIFICATE OF CORRECTION

PATENT NO. : 5,634,285

DATED : June 3, 1997

INVENTOR(S) : William J. Renski

It is certified that error appears in the above-identified patent and that said Letters Patent is hereby corrected as shown below:

Please correct claim 5 as follows:

Column 4, line 45 delete "alienable" and insert --alignable--

Signed and Sealed this

Twenty-seventh Day of January, 1998

*Attest:*

*Attesting Officer*

BRUCE LEHMAN

*Commissioner of Patents and Trademarks*